US005993568A

United States Patent [19]

Takada et al.

[11] Patent Number: 5,993,568

[45] Date of Patent: Nov. 30, 1999

[54] SOFT MAGNETIC ALLOY SHEET HAVING LOW RESIDUAL MAGNETIC FLUX DENSITY

[75] Inventors: Yoshikazu Takada, Kawasaki; Hironori Ninomiya, Machida; Misao Namikawa, Kawasaki; Koichiro Fujita; Shoji Kasai, both of Yokohama; Tatsuhiko Hiratani, Fukuyama, all of Japan

[73] Assignee: NKK Corporation, Tokyo, Japan

[21] Appl. No.: 09/047,742

[22] Filed: Mar. 25, 1998

[51] Int. Cl.[6] ..... H01F 1/04

[52] U.S. Cl. ..... 148/307; 148/304; 148/308; 428/610; 428/611

[58] Field of Search ..... 428/610, 611, 428/928; 148/304, 310, 307, 308, 312, 311

[56] References Cited

U.S. PATENT DOCUMENTS 3,764,381 10/1973 Brissonneau et al. ..... 427/547

4,177,092 12/1979 Thursby et al. ..... 148/113

FOREIGN PATENT DOCUMENTS 62-227033 10/1987 Japan .
62-227034 10/1987 Japan .
62-227035 10/1987 Japan .
62-227036 10/1987 Japan .
62-227077 10/1987 Japan .
4-246157 9/1992 Japan .

OTHER PUBLICATIONS

Patent Abstracts of Japan, vol. 018, No. 226 (C–1194), Apr. 25, 1994, Abstract of JP 06 017202 A (Jan. 1994).

*Primary Examiner*—John Sheehan
*Assistant Examiner*—Andrew L. Oltmans
*Attorney, Agent, or Firm*—Frishauf, Holtz, Goodman, Langer & Chick, P.C.

[57] ABSTRACT

A soft magnetic alloy sheet has low residual magnetic flux density. The alloy sheet comprises a base element and an alloying element having a concentration gradient in a thickness direction of the alloy sheet. The alloying element is selected from Si, Al, Ni, Co and Fe.

10 Claims, 7 Drawing Sheets

SOFT MAGNETIC ALLOY SHEET HAVING LOW RESIDUAL MAGNETIC FLUX DENSITY

BACKGROUND OF THE INVENTION

1. Field of the Invention

The present invention relates to a soft magnetic alloy sheet having low residual magnetic flux density, which is used as a core of distribution transformers, electric power and industrial equipment transformers, direct current sensors, and current transformers.

2. Description of the Related Arts

Generally, distribution transformers use grain-oriented silicon steel sheets because that type of sheets allow the design of high magnetic flux density while suppressing the iron loss to a low level. The grain-oriented silicon steel sheets have, however, a drawback of residual induction owing to their high residual magnetic flux density. When residual induction exists, distribution transformers in buildings and in an environment that widely uses inverter power source may induce overcurrent in case of power failure or in case of reclosing of power because of the saturation of magnetic flux, and may finally result in the occurrence of iron loss in the power source equipment of power distribution system and further the generation of serious damages on other power system. To prevent such defects, distribution transformers are designed to reduce residual magnetic flux density by placing a gap in magnetic path to avoid the occurrence of residual induction.

Owing to the design, the characteristic of high magnetic flux density which is an inherent feature of grain-oriented silicon steel sheets cannot be utilized, and the transformer becomes large. In addition, existence of gap increases iron loss at the gap portion.

Direct current sensors have a gap in magnetic path, and detects the magnetic flux crossing the gap. Also the direct current sensors have similar problem as the distribution transformers have. That is, owing to the high residual magnetic flux density in core, the sensor cannot function in detecting current during a period of decreasing the current from a high level to a low level because of the residual magnetism in the core.

For power and transmission current transformers, cutting may be applied thereto for preventing error in evaluation of break of transmission line induced by the occurrence of residual induction under accidental overcurrent resulted from lightening or the like.

SUMMARY OF THE INVENTION

It is an object of the present invention to provide a soft magnetic alloy sheet having low residual magnetic flux density, which is able to prevent the occurrence of residual induction without giving gap thereto.

To attain the object, the present invention provides a soft magnetic alloy sheet having low residual magnetic flux density, the alloy sheet comprising a base element and an alloying element having a concentration gradient in a thickness direction of the alloy sheet.

It is preferable that the base element is a ferromagnetic element. It is desirable that the alloying element is at least one element selected from the group consisting of Si, Al, Ni, Co and Fe.

It is more preferable that the base element is Fe, the alloying element is Si and the concentration gradient is a concentration gradient of Si having a maximum Si concentration and a minimum Si concentration in the thickness direction.

Preferable embodiments are as follows:

(a) The soft magnetic alloy sheet has a surface layer having a Si concentration of 13 wt. % or less; and a difference between the maximum Si concentration and the minimum Si concentration is at least 0.5 wt. %.

(b) The soft magnetic alloy sheet has an average Si concentration of at most 7 wt. %; and a difference between the maximum Si concentration and the minimum Si concentration is at least 0.5 wt. %.

(c) The soft magnetic alloy sheet has an average Si concentration of at most 7 wt. %; and a difference between the maximum Si concentration and the minimum Si concentration is at least 5.5 wt. %.

(d) The soft magnetic alloy sheet has an average Si concentration of at most 3.5 wt. %; and a difference between the maximum Si concentration and the minimum Si concentration is at least 0.5 wt. %.

(e) The soft magnetic alloy sheet has an average Si concentration of at most 7 wt. %; and a difference between the maximum Si concentration and the minimum Si concentration is from 0.5 to 5.5 wt. %.

(f) The soft magnetic alloy sheet is a grain-oriented silicon steel sheet having a Goss Orientation {(110)<001>};

the silicon steel sheet has a surface layer and a central portion in a thickness direction, a Si concentration in the surface layer is higher than a Si concentration in the central portion; and a difference in Si concentration between the surface layer and the central portion is at least 0.5 wt. %.

DESCRIPTION OF THE EMBODIMENTS

Embodiment 1

Figure 1:
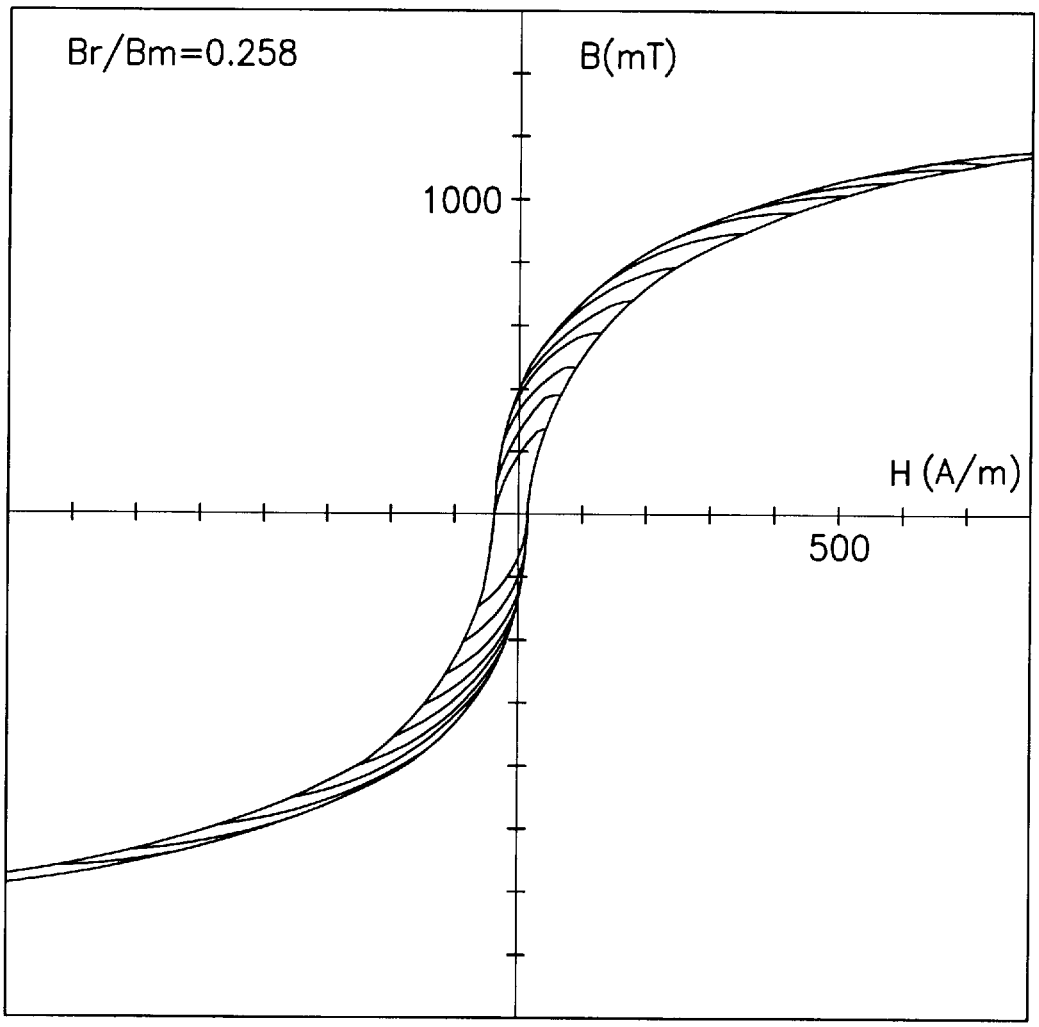
FIG. 1 is a graph illustrating a hysteresis curve of an alloy sheet in which a concentration gradient of alloying element is created in the sheet thickness direction according to the present invention.

It is important to create a concentration gradient of an alloying element in a soft magnetic alloy sheet in a sheet thickness direction thereof. The creation of the concentration gradient significantly decreases residual magnetic flux density without increasing iron loss.

In general, magnetic steel sheets, Permalloy, and the like which are produced by rolling method have almost uniform composition in the sheet thickness direction, and the rectangularity Br/Bm of obtained hysteresis curve is high, generally 0.5 or more. Br denotes the residual magnetic flux density, and Bm denotes the maximum magnetic flux density. On the other hand, it is speculated that, if a concentration gradient of alloying element exists in the sheet thickness direction of an alloy, the alloy structure approaches a structure of three-directional magnetic domain, including sheet thickness direction, in a process of decreasing the applied magnetic field. The phenomenon should induce closed magnetic circuits containing magnetic domains having inverse direction to the direction of applied magnetic field also in the sheet thickness direction, which reduces substantial magnetization in the direction of applied magnetism under a state of zero magnetic field, thus resulting in a reduced residual magnetic flux density.

Embodiment 1 has been derived on the basis of the above-described findings.

That is, Embodiment 1 provides a soft magnetic alloy having low residual magnetic flux density comprising a base element and at least one alloying element, wherein the alloying element has a concentration gradient in the thickness direction of the alloy.

The base element described above is defined as an element which is in a largest content in the alloy, and typically the element existing at 50 wt. % or more in the alloy.

According to the soft magnetic alloy of Embodiment 1, the base element is generally a ferromagnetic element, and the examples of the base element are Ni, Co, and Fe. Examples of alloying element are Si, Al, Ni, Co, and Fe, and one or more of which are contained in the alloy.

Examples of the alloy structuring the soft magnetic alloy according to the invention are Fe—Si alloy, Fe—Al alloy, Fe—Si—Al alloy, Ni—Fe alloy (Permalloy, etc.), and Co—Fe alloy.

The above-described examples are just for reference, and, if any other element than those given above is included as the base element or the alloying element, such an additional element is acceptable as far as the soft magnetic property which is aimed by Embodiment 1 is attained.

Regarding the concentration gradient of alloying element according to Embodiment 1, there is no condition on the profile of gradient, whether the central part in the sheet thickness direction has higher or lower level than that in the edge parts, and, the only requirement is to have a concentration gradient in the sheet thickness direction. The case that a continuous concentration gradient exists from the surface of one side to the surface of other side is also included. The method to create that type of concentration gradient is not specifically limited, and a preferred method is to form a layer containing an element to create a concentration gradient on the base material using CVD (chemical vapor deposition), PVD (physical vapor deposition), electroplating, and the like, followed by, if necessary, applying adequate diffusion treatment. Alternatively, a method of rolling laminated metal sheets having different metals or different concentration of added elements to each other, for example a process for manufacturing clad steel sheet, is also applicable for that purpose. The alternative method, however, undergoes heat treatment for diffusion joining, at need, because the interface of metal sheets (or metallic layers) are requested to have a ferromagnetic joining.

As a feature of the hysteresis curve of the soft magnetic alloy according to the present invention, there is a Bm dependency of Br/Bm which is the ratio of the residual magnetic flux density Br to the maximum magnetic flux density Bm. That is, increase in Bm saturates Br, so that the increase in Bm lowers the value of Br/Bm. Accordingly, there is an advantage of attaining a high level of magnetic flux density in practical application.

When an Fe—Si alloy (silicon steel sheet) which is widely used in distribution transformers is applied to the alloy according to the present invention, the alloy is easily manufactured by CVD process using silicon tetrachloride and the like. For example, Si is diffused into the surface layer of base material of pure iron or 3% Si—Fe using CVD process. In that case, the Si content in the surface layer becomes higher than that in deeper portion, and during the reaction period, $Fe_3Si$ (Si: 13 wt. %) is formed in the uppermost surface layer of the base material. Since the concentration gradient is able to be changed by diffusion annealing, the diffusion annealing is applied at need. The concentration difference in sheet thickness direction in that case is preferably 0.5 wt. % or more to prevent degradation of the effect of reducing the residual magnetic flux density.

The above-given description on Embodiment 1 deals with an alloy. Nevertheless, the invention is applicable also to a soft magnetic oxide. For example, creating a Zn concentration gradient in a MnZn ferrite can reduce the residual magnetic flux density.

EXAMPLE 1

A soft magnetic alloy was prepared using a base material of thin iron sheet having a thickness of 2 mm, in which a concentration gradient of Al, Si, Ni, and Co was created in the sheet thickness direction. From the result of determination of the magnetic field H and the magnetic flux density B, a direct current hysteresis curve was drawn. The Al and Si were deposited by CVD process, and Ni and Co were deposited by electron beam or electroplating onto the surface of the sheet, followed by diffusion annealing. The concentration difference of each element between surface layer and deeper part was selected to 2%. The rectangularity (Br/Bm) of the sheet with thus created concentration gradient was compared with the rectangularity (Br/Bm) of a sheet without having concentration gradient. The result is shown in Table 1. The rectangularity (Br/Bm) was used as an evaluation criterion of the residual magnetic flux density.

TABLE 1

| Concentration gradient | Si | Al | Ni | Co |
|---|---|---|---|---|
| Exists | 0.3 | 0.35 | 0.4 | 0.4 |
| Not exists | 0.8 | 0.7 | 0.85 | 0.9 |

(Figures are rectangularity Br/Bm)

As seen in the table, a soft magnetic material having a concentration gradient of alloying element gives less rectangularity than that of a material having no concentration gradient, thus establishing a low residual magnetic flux density.

EXAMPLE 2

Figure 2:
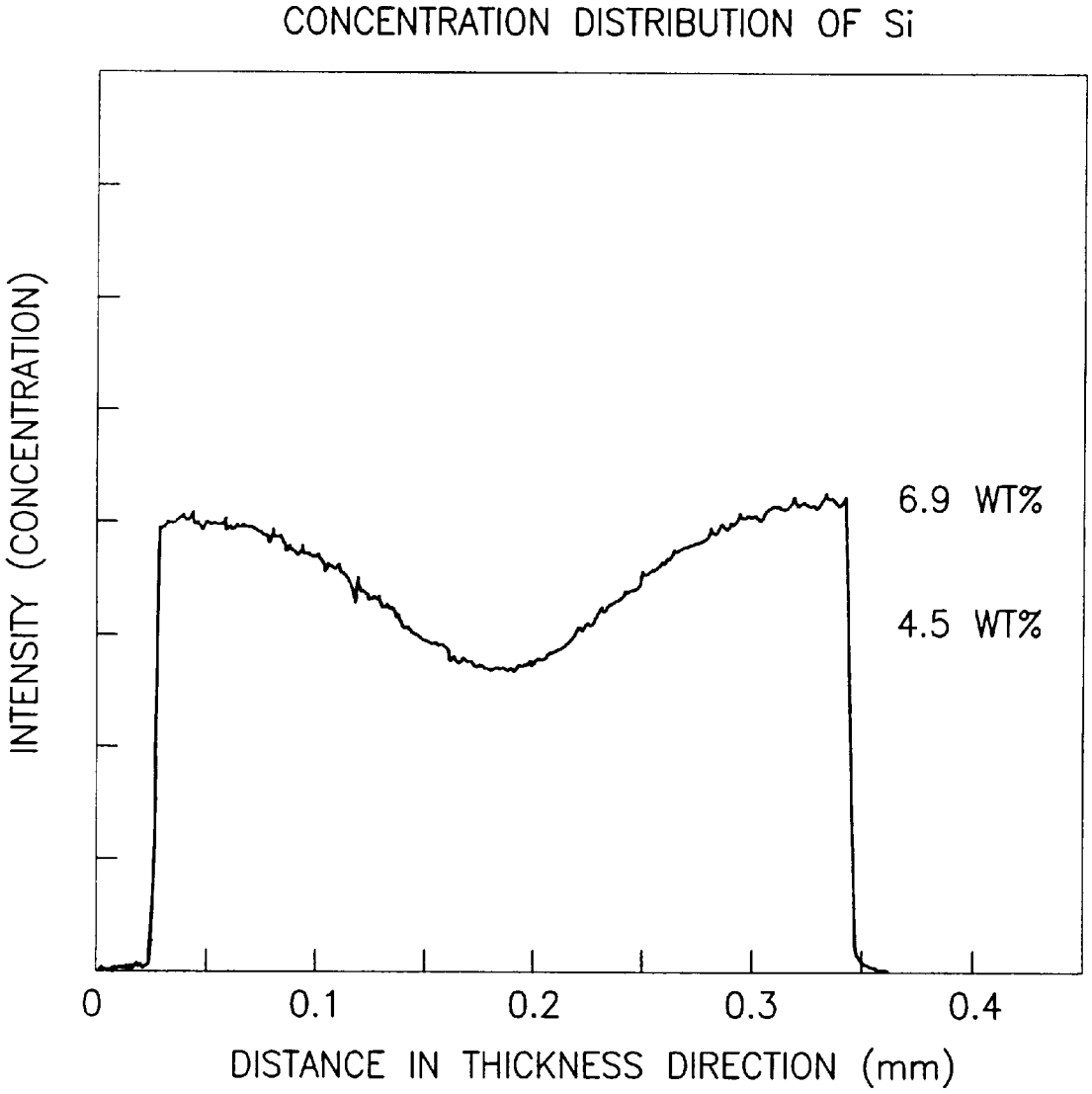
FIG. 2 is a chart illustrating an observed result of concentration gradient of an alloy sheet in which a concentration gradient of alloying element is created according to the present invention.

A non-oriented silicon steel sheet having a thickness of 0.3 mm was subjected to siliconizing by CVD process, then underwent a short period of diffusion annealing to adjust the Si content to 6.9 wt. % in the surface layer and to 4.5 wt. % in deeper part of the sheet. The magnetic characteristics of thus prepared steel sheet were evaluated by Epstein test. FIG. 1 shows the hysteresis curve of the steel sheet observed at 50 Hz. FIG. 2 shows the Si concentration distribution in sheet thickness direction of the steel sheet observed by electron probe microanalyzer (EPMA).

Figure 3:
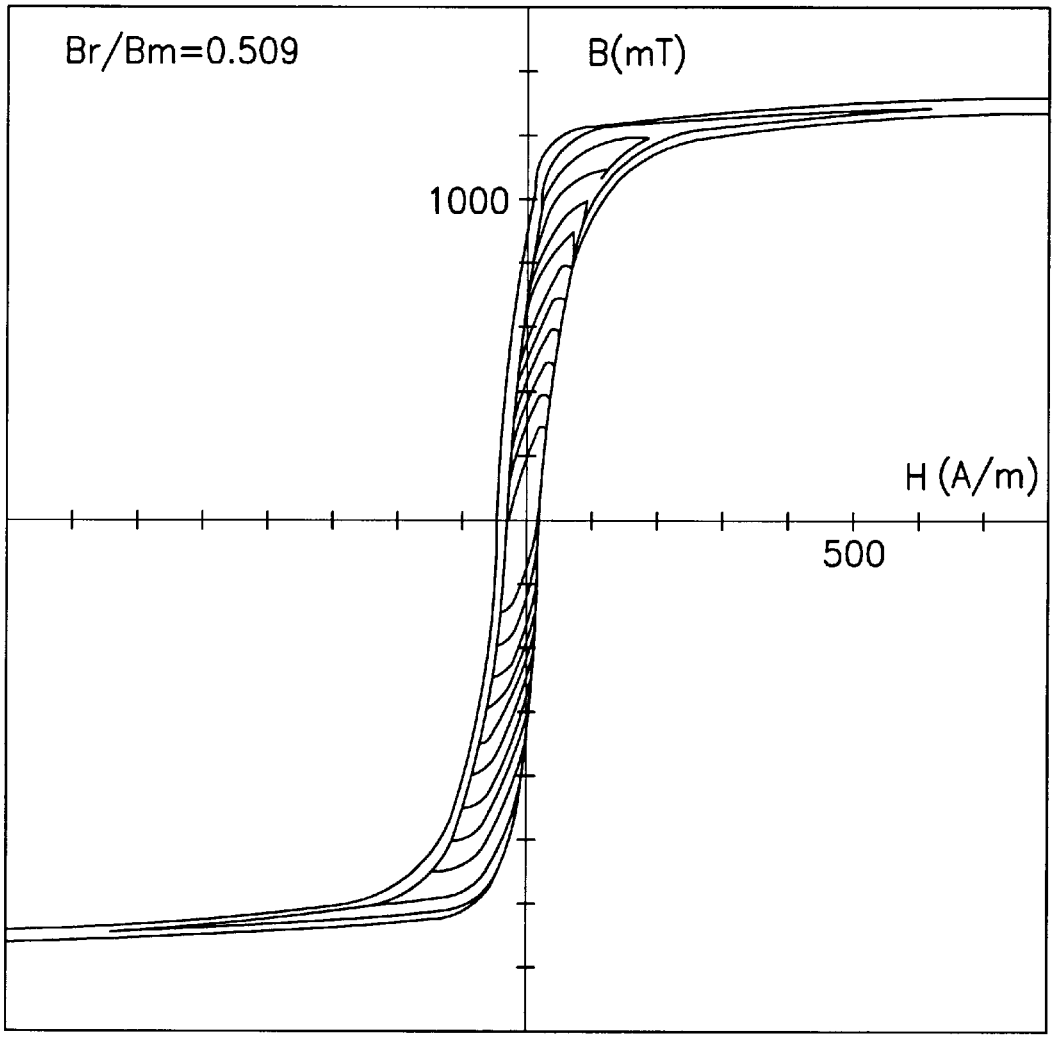
FIG. 3 is a graph illustrating a hysteresis curve of an alloy sheet having uniform composition in the sheet thickness direction.

As a comparative sample, a steel sheet containing the same amount of silicon while keeping the Si concentration in uniform distribution in sheet thickness direction was prepared by applying full diffusion treatment. FIG. 3 shows the hysteresis curve of the steel sheet observed at 50 Hz. The total silicon content was 5.9 wt. %.

Table 2 shows the manufacturing condition, the rectangularity (Br/Bm), and the iron loss ($W_{14/50}$) for each of the above-described with-concentration gradient and without-concentration gradient.

TABLE 2

| Concentration gradient | $SiCl_4$ concentration (%) | CVD diffusion temperature (° C.) | Diffusion time (min.) | Rectangularity (Br/Bm) | Iron loss $W_{14/50}$ (W/kg) |
|---|---|---|---|---|---|
| Exists | 20 | 1200 | 15 | 0.26 | 1.1 |
| Not exists | 13 | 1200 | 30 | 0.51 | 2.2 |

From the data given above, it was confirmed that a concentration gradient of Si which is an alloying element in the thickness direction of the steel sheet provides a practically applicable soft magnetic material for cores having low residual magnetic flux density and low iron loss.

EXAMPLE 3

A Ni—Fe alloy sheet having a thickness of 0.2 mm was treated by vapor deposition of Ni or Fe onto the surface thereof under the conditions given in Table 3, separately, followed by applying diffusion treatment to prepare respective Sample A and Sample B, in which a concentration gradient was created in sheet thickness direction. Comparative sample having no concentration gradient was prepared for each of Sample A and Sample B. Table 4 shows the rectangularity (Br/Bm) determined from the direct current hysteresis curve of each of the samples.

TABLE 3

| Sample | Base material | Vapor deposition | Deposited element | Thickness of deposit (μm) | Diffusion temperature (° C.) | Time of diffusion |
|---|---|---|---|---|---|---|
| A | 45% Ni—Fe | Electro-plating | Ni | 20 | 1250 | 1 |
| B | 80% Ni—Fe | Electron beam deposition | Fe | 10 | 1200 | 1 |

TABLE 4

| Concentration gradient | Sample A | Sample B |
|---|---|---|
| Exists | 0.3 | 0.35 |
| Not exists | 0.7 | 0.8 |

(Figures are rectangularity Br/Bm)

As shown in Table 4, creation of concentration gradient of an alloying element in the thickness direction of the sheet proved to provide a soft magnetic alloy having low residual magnetic flux density.

EXAMPLE 4

Ion implantation was applied to an Fe—Si—B amorphous soft magnetic alloy to implant B. After that, heat treatment at 200° C. was applied to the alloy aiming at removal of defects generated by ion implantation and also at enhancement of diffusion of B. The concentration difference between surface layer and deeper part was 0.8 wt. %. For comparison, a sample having no concentration gradient of B was prepared by applying long time of heat treatment. The rectangularity of thus prepared materials were determined. The result is shown in Table 5. As shown in Table 5, it is possible to decrease the residual magnetic flux density by creating a concentration gradient of alloying element in the sheet thickness direction.

TABLE 5

| Concentration gradient | Rectangularity (Br/Bm) |
|---|---|
| Exists | 0.45 |
| Not exists | 0.92 |

Embodiment 2

A residual magnetic flux density is significantly lowered without increasing iron loss by specifying an average Si concentration in a silicon steel sheet and creating a specific concentration gradient of Si in the silicon steel sheet in a sheet thickness direction. By further specifying the average Si concentration and the Si concentration gradient, the residual magnetic flux density is further lowered, the iron loss is lowered, or the saturation magnetic flux density is increased.

The silicon steel sheet according to Embodiment 2 comprises an average Si concentration of 7 wt. % or less, a Si concentration gradient in thickness direction of the silicon steel sheet, and a difference between the maximum Si concentration and the minimum Si concentration in the thickness direction being 0.5 wt. % or more.

Figure 4:
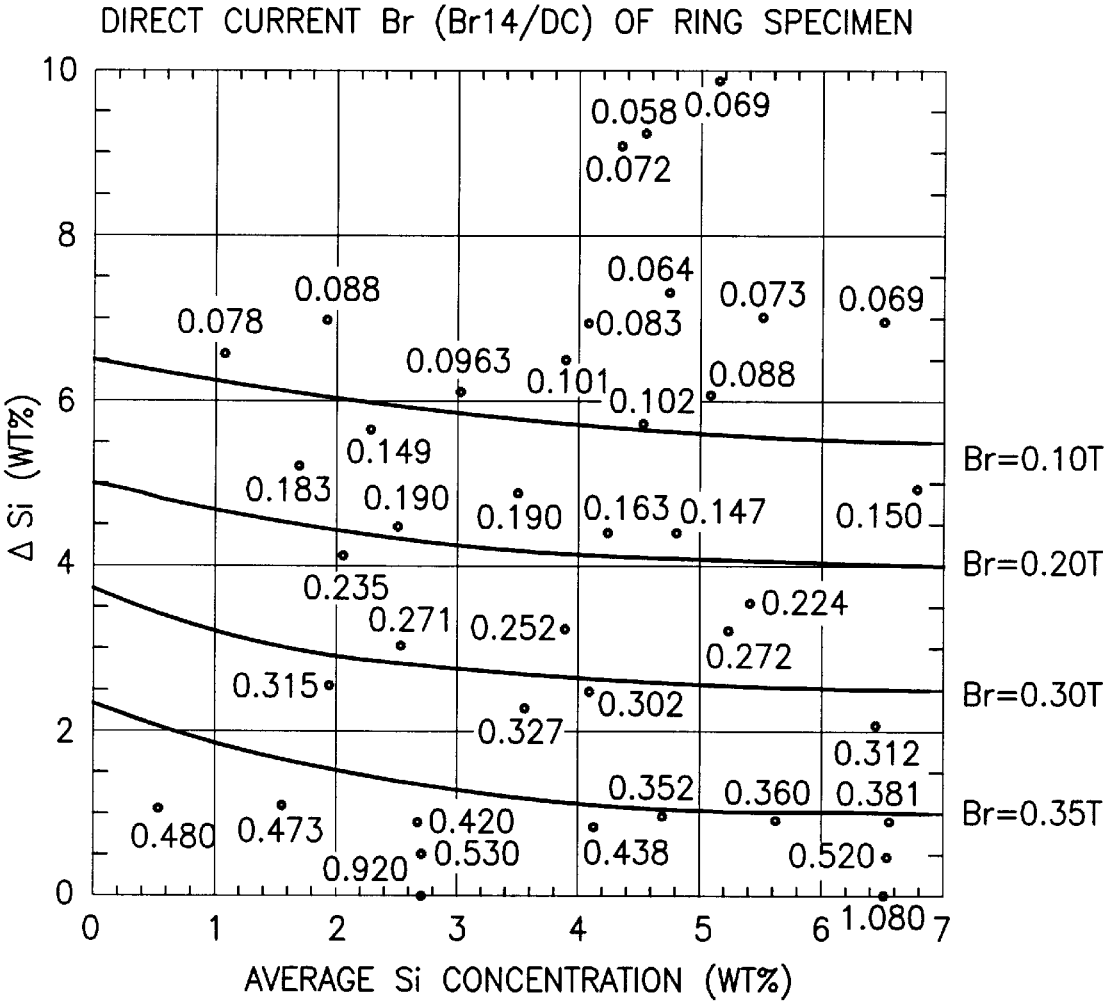
FIG. 4 is a graph showing the values of residual magnetic flux density Br with several levels of average Si concentration and ΔSi under magnetization up to the maximum magnetization level of Bm=1.4 T.

FIG. 4 shows the values of residual magnetic flux density (Br) in the case that a Si concentration gradient is created in sheet thickness direction. The samples used were taken from a steel sheet having a thickness of 0.3 mm prepared by rolling method, followed by siliconizing in a $SiCl_4$ atmosphere at 1200° C. and then by diffusion treatment in a $N_2$ atmosphere at 1200° C. to create various kinds of Si content and Si concentration gradient in sheet thickness direction. The horizontal axis is the average Si content, and the vertical axis is the difference of Si concentration between the maximum and the minimum, or ΔSi. FIG. 4 indicates the residual magnetic flux density Br on each of the direct current BH curves under magnetization of individual points up to the maximum magnetization Bm=1.4 T. The values of ΔSi are the result of EPMA (electron probe microanalyzer) on a cross section of each sample.

FIG. 4 suggests that the creation of Si concentration gradient in sheet thickness direction and the increase in ΔSi monotonously decrease the residual magnetic flux density. If the value of ΔSi is selected to 0.5% or more, then sufficiently low residual magnetic flux density is obtained.

Therefore, Embodiment 2 includes the requirements to create a Si concentration gradient and to adjust the difference of Si concentration between the maximum and the minimum thereof, or ΔSi, to 0.5 wt. % or more. More preferably, ΔSi is 0.7 wt. % or more to obtain stably a low residual magnetic flux density.

As seen in FIG. 4, when the value of ΔSi is 5.5 wt. % or more, a very low residual magnetic flux density as low as 0.1 T or less is obtained. Consequently, Embodiment 2 includes a requirement of 5.5 wt. % or more of ΔSi for decreasing the residual magnetic flux density.

In that case, the method to determine Si concentration in sheet thickness direction is not specifically limited, and an X-ray microanalyzer such as EPMA is preferred.

The concept to create a Si concentration gradient in thickness direction of steel sheet is disclosed in Japanese Patent Publication Laid-Open Nos. 62-227033 through 62-227036, Japanese Patent Publication Laid-Open No. 62-227077, and Japanese Patent Publication Laid-Open No. 4-246157. The object of the disclosed patent publications is to shorten the diffusion treatment time by an intermission of diffusion treatment during the manufacturing process of high silicon steel sheet using siliconizing process. The Si concentration gradient is created simply as a result of the treatment. Accordingly, these patent publications do not imply a concept to positively create a Si concentration gradient. According to these patent publications, the period of intermission of diffusion treatment is determined in a range not to degrade iron loss. The iron loss is determined by various variables, and the reduction of iron loss needs to increase the residual magnetic flux density. Consequently, the technology disclosed in the above-described patent publications can be said to determine the allowable limit of Si concentration gradient within a range not to excessively reduce the residual magnetic flux density. To the contrary, Embodiment 2 creates positively a Si concentration gradient to reduce the residual magnetic flux density, so that the technical concept according to Embodiment 2 completely differs from that in the above-described patent publications.

Figure 5:
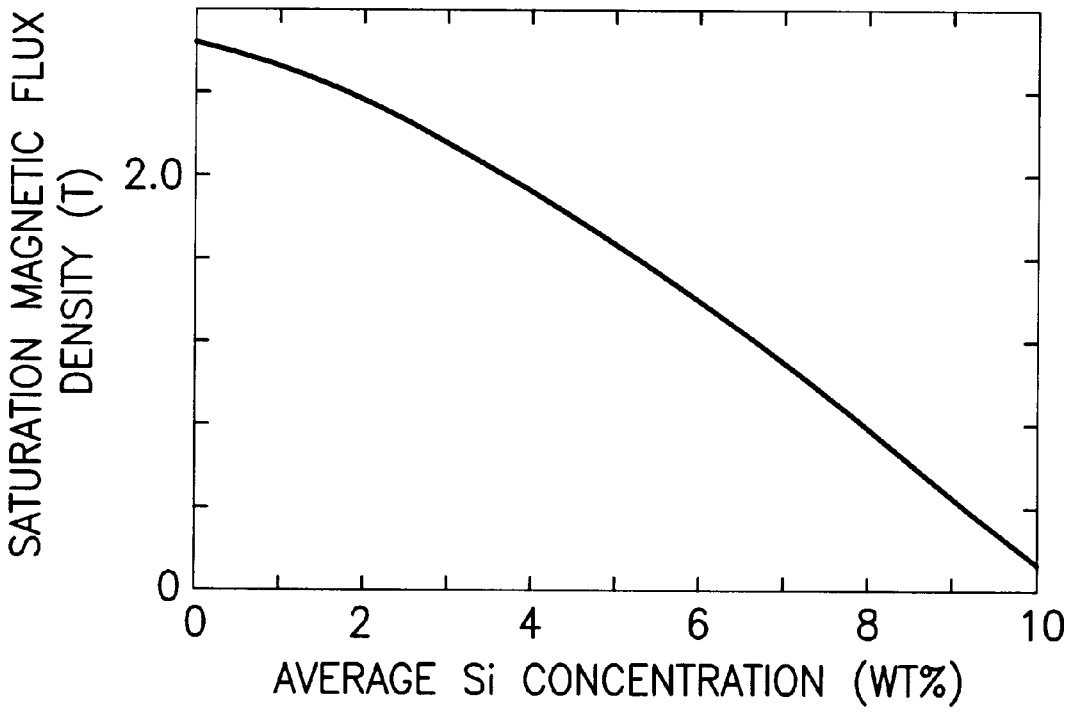
FIG. 5 is a graph showing a relation between the average Si concentration and the saturation magnetic flux density.

Inrush current induced by residual induction relates to a saturation magnetic flux density as well as the residual magnetic flux density, and the inrush current decreases with increase in the saturation magnetic flux density. To this point, even when a concentration gradient is created in sheet thickness direction to decrease the residual magnetic flux density, sufficient effect cannot be expected if the saturation magnetic flux density decreases. Since, as seen in FIG. 5, the saturation magnetic flux density is inversely proportional to an average Si amount added, excessive Si content is unfavorable. When, the average Si concentration exceeds 7%, the workability is degraded, and punching performance is significantly degraded. Therefore, the present invention includes a requirement to secure the Si concentration to 7 wt. % or less as an average.

Decrease in Si content increases the saturation magnetic flux density. Particularly when the Si content becomes to 3.5 wt. % or less, the saturation magnetic flux density becomes remarkably high value, or 2.0 T or more. Consequently, Embodiment 2 sets a condition to particularly increase the saturation magnetic flux density by specifying the Si concentration to 3.5 wt. % or less, the creation of Si concentration gradient in sheet thickness direction, and the difference of concentration between the maximum and the minimum thereof to 0.5 wt. % or more.

The average Si concentration referred in Embodiment 2 is the one obtained by chemical analysis.

Regarding the concentration gradient of alloying element according to Embodiment 2, there is no condition on the profile of gradient, whether the central part in the sheet thickness direction has higher or lower level than that in the edge parts, and, the only requirement is to have a concentration gradient in the sheet thickness direction. The case that a continuous concentration gradient exists from the surface of one side to the surface of other side is also included. The method to create that type of concentration gradient is not specifically limited, and a preferred method is siliconizing in a $SiCl_4$ atmosphere as described above, followed by diffusion treatment.

As a feature of the hysteresis curve of the soft magnetic alloy according to the present invention, there is a Bm dependency of Br/Bm which is the ratio of the residual magnetic flux density Br to the maximum magnetic flux density Bm. That is, increase in Bm saturates Br, so the increase in Bm lowers the value of Br/Bm. Accordingly, there is an advantage of attaining a high level of magnetic flux density in practical application.

Figure 6:
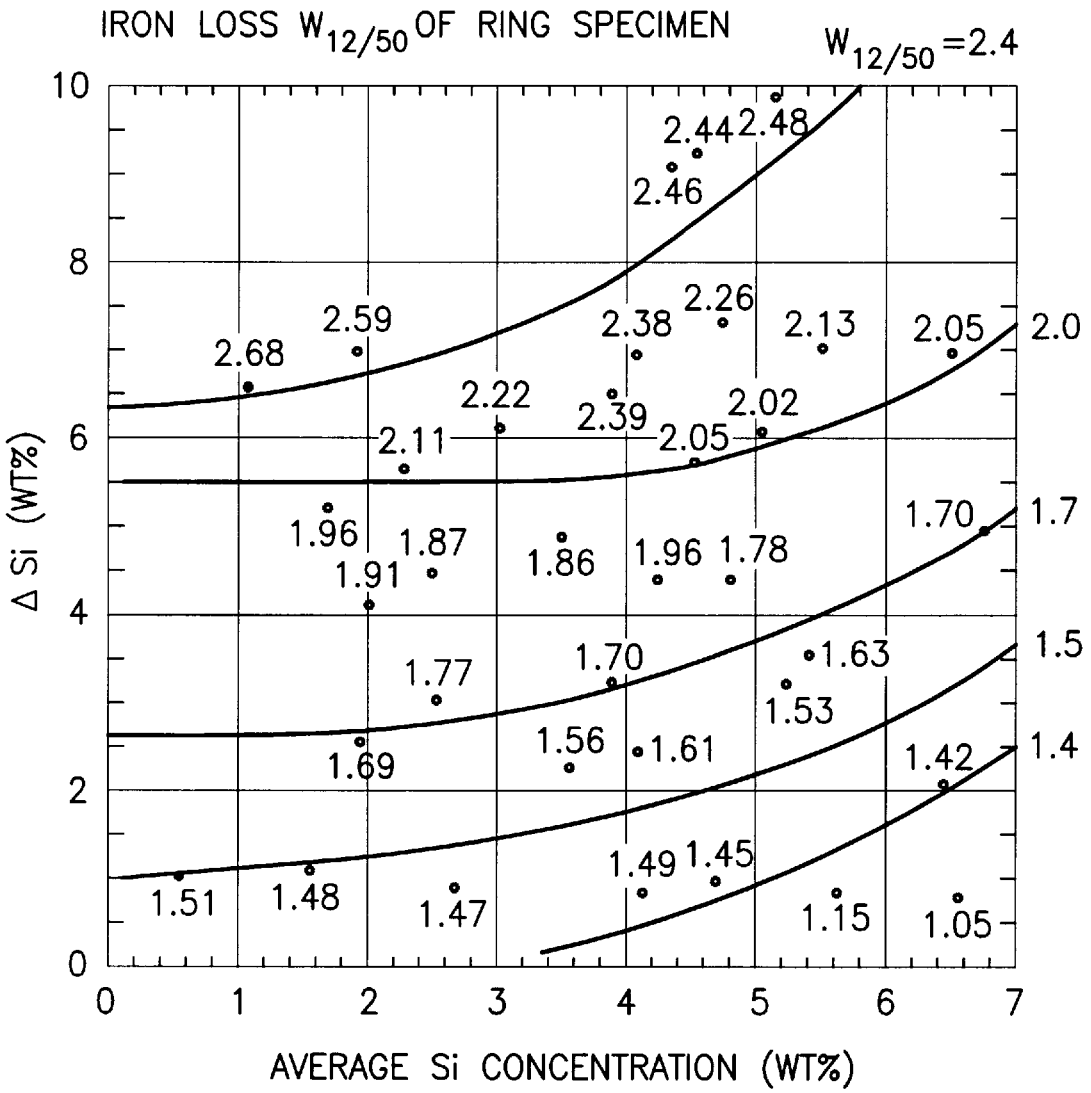
FIG. 6 is a graph showing the values of iron loss $W_{12/50}$ with several levels of average Si concentration and of ΔSi under a condition of 50 Hz AC and Bm=1.2 T.

Regarding the iron loss, FIG. 6 shows the data of iron loss $W_{12/50}$ observed in the steel sheet used in the analysis of FIG. 4 under a condition of 50 Hz AC and 1.2 T of Bm. The figure shows that, by satisfying the basic requirements of the present invention, or by specifying the Si concentration to 7 wt. % or less, the creation of Si concentration gradient in sheet thickness direction, and the difference of concentration between the maximum and the minimum thereof to 0.5 wt. % or more, a practically applicable silicon steel sheet having less residual magnetic flux density and low iron loss is obtained.

FIG. 6 also indicates that, within a range of ΔSi from 0.5 to 5.5 wt. %, the iron loss becomes very low, or $W_{12/50}$ being 2.0 W/kg or less. Therefore, the present invention specifies the Si concentration to 7 wt. % or less as an average, the creation of a Si concentration gradient in sheet thickness direction, and the difference of concentration between the maximum and the minimum thereof to a range of from 0.5 to 0.5 wt. %, for particularly decreasing the iron loss while maintaining the residual magnetic flux density at a low level.

According to embodiment 2, elements other than Si are not specifically specified, and the other elements are acceptable if only they are at a level existing in ordinary silicon steel sheets.

EXAMPLE

A steel sheet having a thickness of 0.3 mm and having a composition given in Table 6 was prepared by rolling process. The sheet was subjected to siliconizing in a $SiCl_4$ atmosphere at 1200° C., followed by diffusion treatment in a $N_2$ atmosphere at 1200° C. to produce a silicon steel sheet having a Si concentration gradient in sheet thickness direction.

TABLE 6

| | C | Si | Mn | P | S | sol. Al | wt. % N |
|---|---|---|---|---|---|---|---|
| Steel sheet A | 0.002 | <0.1 | 0.01 | 0.003 | 0.0009 | 0.001 | 0.001 |
| Steel sheet B | 0.003 | 2.86 | 0.01 | 0.003 | 0.0003 | 0.001 | 0.002 |

The average Si concentration of the prepared sample was determined by wet analysis, and the difference of Si concentration between the maximum and the minimum thereof, or ΔSi, was determined by EPMA. As for the steel sheet A in Table 6, the average Si concentration of prepared sample was in a range of from 0.4 to 3.0 wt. %. For the steel sheet B in Table 6, the average Si concentration of prepared sample was in a range of from 3.5 to 6.8 wt. %. The content of elements other than Si showed very little change before and after the siliconizing.

From thus prepared steel sheet, specimens in ring shape having the dimensions of 31 mm in outer diameter and 19 mm in inner diameter were cut to prepare. These specimens were subjected to determination of direct current BH curves and 50 Hz Ac magnetic characteristics.

FIG. 4 shows the values of residual magnetic flux density Br on direct current BH curves under magnetization up to the maximum magnetization level Bm=1.4 T. As seen in FIG. 4, it was proved that the silicon steel sheet having low residual magnetic flux density Br is obtained by creating a Si concentration gradient in sheet thickness direction at a Si concentration level of this example and by selecting the value of ΔSi to 0.5 wt. % or more. Furthermore, by bringing the value of ΔSi to 5.5 wt. % or more, a very low Br value as low as 0.1 T or less was realized. The relation between the average Si concentration and the saturation magnetic flux density is given in FIG. 5. As shown in FIG. 5, the saturation magnetic flux density became extremely high level, or 2.0 T or more, at an average Si concentration of 3.5 wt. % or more.

FIG. 6 shows the values of iron loss $W_{12/50}$ observed under a condition of 50 Hz AC and 1.2 T of Bm. As seen in FIG. 6, it was proved that the practically applicable silicon steel sheet having low residual magnetic flux density and low iron loss is obtained by creating a Si concentration gradient in sheet thickness direction at a Si concentration level of this example and by selecting the value of ΔSi to 0.5 wt. % or more. In addition, under a condition of ΔSi in a range of from 0.5 to 5.5 wt. %, an extremely low iron loss, or $W_{12/50}$ being 2.0 W/kg or less, was obtained.

Embodiment 3

The inventors found that the creation of a Si concentration gradient in a sheet thickness direction significantly decreases the residual magnetic flux density.

Embodiment 3 was completed based on the above-described findings. Embodiment 3 provides a grain-oriented silicon steel sheet having low residual magnetic flux density, having a Si concentration gradient in the sheet thickness direction thereof, wherein a Si concentration in a surface layer is higher than that at a central portion of the sheet thickness thereof and the difference in Si concentration between the surface layer and the central portion of the sheet thickness is 0.5 wt. % or more.

It is preferable that an average Si concentration over the total sheet thickness is in a range of from 3 to 7 wt. %. It is desirable that the Si concentration in the surface layer is 7.5 wt. % or less.

Figure 7:
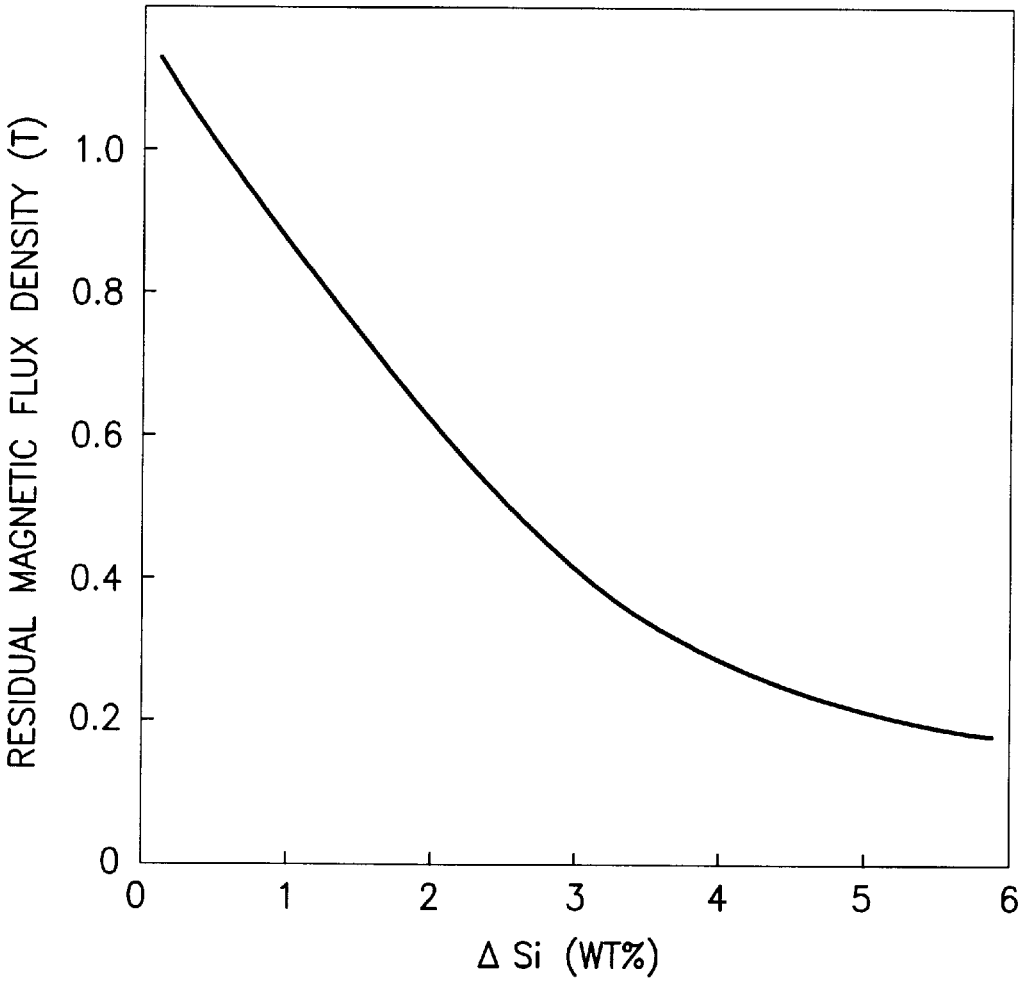
FIG. 7 is a graph showing a relation between the ΔSi and residual magnetic flux density

FIG. 7 shows the change of values of residual magnetic flux density (Br) in the case that a Si concentration gradient is created in sheet thickness direction of the grain-oriented silicon steel sheet. The sample used was prepared by siliconizing a grain-oriented silicon steel sheet containing 3.1 wt. % of Si and having a thickness of 0.3 mm. The siliconization was carried out by reacting the steel sheet heated to 1200° C. with a mixed gas of 20 vol. % of $SiCl_4$ and 80 vol. % of $N_2$, thus penetrating Si from the surface of the steel sheet, followed by soaking the steel sheet in $N_2$ atmosphere to perform diffusion to a central portion of the sheet thickness. Various kinds of samples having different Si concentration gradients were prepared by changing the Si penetration time and the diffusion time. The magnetic characteristics of thus prepared samples were determined.

FIG. 7 illustrates data of residual magnetic flux density observed under a condition of 50 Hz and magnetization up to 1.4 T. The horizontal axis is the difference of Si concentration between the maximum and the minimum thereof, or ΔSi, derived from quantitative analysis of Si on a cross section of sample using EPMA.

As shown in FIG. 7, the creation of Si concentration gradient in sheet thickness direction and the increase of the ΔSi monotonously decrease the residual magnetic flux density. FIG. 7 also suggests that, to decrease the residual magnetic flux density by 10% or more, the value of ΔSi is necessary to be selected to 0.5% or more.

Therefore, it is necessary in Embodiment 3 to create a Si concentration gradient and to establish a minimum Si concentration at near the center of the sheet thickness lower than the Si concentration in the surface layer by 0.5 wt. % or more.

In that case, the method for determining Si concentration in sheet thickness direction is not specifically limited, and a EPMA is preferred.

The grain-oriented silicon steel sheet according to Embodiment 3 is typically the one having one orientation such as the Goss orientation. Nevertheless, Embodiment 3 is not limited to the one having one orientation.

Since a Goss-oriented silicon steel sheet as the base material becomes difficult to form Goss orientation if the average Si concentration over the total sheet thickness is 3 wt. % or less, the average Si concentration is preferably 3 wt. % or more. On the other hand, if the average Si concentration increases, the Si concentration in the surface layer increases to deteriorate workability. From the standpoint of the workability, the surface Si concentration is preferably 7.5 wt. % or less, thus the average Si concentration is preferably 7 wt. % or less. Accordingly, Embodiment 3 specifies a preferred value of average Si concentration to a range of from 3 to 7 wt. %, and, further specifies a preferred Si concentration in the surface layer to 7.5 wt. % or less.

According to Embodiment 3, elements other than Si are not specifically specified, and these other elements are acceptable if only they are at a level contained in ordinary grain-oriented silicon steel sheets.

EXAMPLE

A grain-oriented silicon steel sheet having a thickness of 0.3 mm, having a Goss orientation, and having a composition given in Table 7 was treated by siliconizing and diffusion in a continuous siliconizing line to create a Si concentration in sheet thickness direction. The applied siliconizing line comprises a heating zone, a siliconizing zone, a diffusion zone, a cooling zone, and an insulation film coating unit. In the siliconizing line, the sheet was heated to 1200° C., then reacted with $SiCl_4$ gas to form $Fe_3Si$ on the surface of the steel sheet, followed by diffusion-soaking to diffuse Si into the central portion of the sheet thickness to create a Si concentration gradient. During the treatment, the concentration of $SiCl_4$ gas and the soaking time were changed to prepare steel sheets having different Si profile to each other. All the steel sheets contained similar composition of elements other than Si before and after the siliconization to each other.

TABLE 7

WT %

| C | Si | Mn | S | sol. Al | N |
|---|---|---|---|---|---|
| 0.002 | 3.25 | 0.074 | 0.024 | 0.029 | 0.0086 |

From each of thus prepared silicon sheets, a transformer with 50 Hz, single phase, and 1 kVA of capacity was fabricated, and the inrush current was determined under a phase control. The observed values of residual magnetic flux density, magnetic flux density B8, and inrush current are shown in Table 8. The residual magnetic flux density was the value determined under a condition of 50 Hz and magnetization up to 1.4 T. The inrush current was the value determined under a condition that the transformer was magnetized up to 1.4 T, and was expressed by a ratio to the rated current. Table 8 shows the observed values of ΔSi, Si concentration in the surface layer, average Si concentration, residual magnetic flux density, magnetic flux density B8, and inrush current ratio.

TABLE 8

| No. | Sample | ΔSi (wt %) | Si concentration in surface layer (wt %) | Average Si concentration (wt %) | Residual magnetic flux density (T) | Magnetic flux density B8 (T) | Inrush current ratio |
|---|---|---|---|---|---|---|---|
| 1 | Comparative material | 0.3 | 6.65 | 6.43 | 1.02 | 1.74 | 23 |
| 2 | Material of Embodiment 3 | 1.6 | 6.61 | 5.64 | 0.70 | 1.80 | 7 |
| 3 | Material of Embodiment 3 | 2.1 | 7.93 | 6.78 | 0.59 | 1.78 | 5 |
| 4 | Material of Embodiment 3 | 2.0 | 6.01 | 4.96 | 0.60 | 1.86 | 5 |
| 5 | Material of Embodiment 3 | 0.6 | 5.31 | 4.96 | 0.93 | 1.87 | 11 |

The table proved that the conditions satisfying the range of the present invention give low residual magnetic flux density so that the inrush current characteristics are superior. Consequently, it was proved that the present invention provides a grain-oriented silicon steel sheet for transformers giving low inrush current. The sample No. 3 in Table 8 was inferior in workability owing to large Si content.

What is claimed is:

1. A soft magnetic alloy sheet having low residual magnetic flux density, the alloy sheet comprising:

a base element;

the base element being Fe;

an alloying element having a concentration gradient in the thickness direction of the alloy sheet;

the alloying element being Si and the concentration gradient being a concentration gradient of Si having a maximum Si concentration and a minimum Si concentration in the thickness direction;

the soft magnetic alloy sheet having an average Si concentration of at most 7 wt. %; and the difference between the maximum Si concentration and the minimum Si concentration being at least 5.5 wt. %.

2. A soft magnetic alloy sheet having residual magnetic flux density of 0.530 T or less, the alloy sheet comprising:

a base element;

the base element being Fe;

an alloying element having a concentration gradient in the thickness direction of the alloy sheet;

the alloying element being Si and the concentration gradient being a concentration gradient of Si having a maximum Si concentration and a minimum Si concentration in the thickness direction;

the soft magnetic alloy sheet having an average Si concentration of at most 3.5 wt. %; and the difference between the maximum Si concentration and the minimum Si concentration being at least 0.5 wt. %.

3. A soft magnetic alloy sheet having residual magnetic flux density of 0.530 T or less, the alloy sheet comprising:

a base element;

the base element being Fe, an alloying element having a concentration gradient in the thickness direction of the alloy sheet;

the alloying element being Si and the concentration gradient being a concentration gradient of Si having a maximum Si concentration and a minimum Si concentration in the thickness direction;

the soft magnetic alloy sheet having an average Si concentration of at most 7 wt. %; and the difference between the maximum Si concentration and the minimum Si concentration being from 0.5 to 5.5 wt. %.

4. The soft magnetic alloy sheet having low residual magnetic flux density, the alloy sheet comprising:

a base element;

the base element being Fe:

an alloying element having a concentration gradient in the thickness direction of the alloy sheet;

the alloying element being Si and the concentration gradient being a concentration gradient of Si having a maximum Si concentration and a minimum Si concentration in the thickness direction;

the soft magnetic alloy sheet being a grain-oriented silicon steel sheet having a Goss Orientation {(110) <001>};

the silicon steel sheet having a surface layer and a central portion in the thickness direction, the Si concentration in the surface layer being higher than the Si concentration in the central portion;

and the difference in Si concentration between the surface layer and the central portion being at least 0.5 wt. %.

5. The soft magnetic alloy sheet of claim 4, wherein the Si concentration in the surface layer is at most 7.5 wt. %.

6. The soft magnetic alloy sheet of claim 4, having an average Si concentration of 3 to 7 wt. % in the thickness direction.

7. The soft magnetic alloy sheet of claim 1, wherein the average Si concentration is 3.5 to 7 wt. %.

8. The soft magnetic alloy sheet of claim 2, wherein the average Si concentration is 0.4 to 3 wt. %.

9. The soft magnetic alloy sheet of claim 2, wherein the difference between the maximum Si concentration and the minimum Si concentration is from 0.5 to 5.5 wt. %.

10. The soft magnetic alloy sheet of claim 3, wherein the soft magnetic alloy sheet has an average Si concentration of 3.5 to 7 wt. %.

* * * * *